US005971773A

United States Patent [19]

Riddle

[11] Patent Number: 5,971,773

[45] Date of Patent: Oct. 26, 1999

[54] SOLDERLESS ELECTRICAL CONNECTOR

[75] Inventor: Douglas Edward Riddle, Corona, Calif.

[73] Assignee: Packard Hughes Interconnect Company, Irvine, Calif.

[21] Appl. No.: 09/064,406

[22] Filed: Apr. 22, 1998

[51] Int. Cl.[6] ..... H01R 9/09

[52] U.S. Cl. ..... 439/67; 439/493

[58] Field of Search ..... 439/67, 62, 493

[56] References Cited

U.S. PATENT DOCUMENTS 4,125,310 11/1978 Reardon, II, et al. .
4,377,316 3/1983 Ecker et al. ..... 439/67
4,453,805 6/1984 Moulin .
4,647,125 3/1987 Landi et al. ..... 439/67
4,895,523 1/1990 Morrison et al. .
5,064,377 11/1991 Wood ..... 439/67
5,161,986 11/1992 Gulbranson et al. ..... 439/67

*Primary Examiner*—Lincoln Donovan
*Assistant Examiner*—J. F. Duverne
*Attorney, Agent, or Firm*—Cary W. Brooks; Patrick M. Griffin

[57] ABSTRACT

An electrical connector has a flexible printed circuit for interconnecting a mother board and two daughter boards. The electrical connector includes a connector housing that is attached to the bottom of a heat frame that holds the two daughter boards. The connector is secured to the mother board. The flexible printed circuit is looped around a compression plate in the housing and attached to the heat frame and daughter boards at each end by compression assemblies that press gold dot contacts of the flexible printed circuit against the daughter boards.

14 Claims, 3 Drawing Sheets

SOLDERLESS ELECTRICAL CONNECTOR

The U.S. Government may have rights in this invention.

TECHNICAL FIELD

This invention relates generally to electrical connectors and more particularly to an electrical connector having a flexible printed circuit for connecting printed circuit boards electrically.

BACKGROUND OF THE INVENTION

U.S. Pat. No. 4,895,523 granted to Brian D. Morrison and Jack Rosenberg Jan. 23, 1990, discloses a controlled impedance connector that has two flexible printed circuits that are wrapped around a connector housing and secured against the outer walls of the housing by two pressure plates. Each flexible printed circuit connects two printed wiring boards (daughter boards) comprising surface mounted devices to a mother board. The daughter boards are bonded to opposite sides of a central heat frame that is attached to a flange of the connector housing by jacking screws. The daughter boards and the flexible printed circuits are connected electrically in two ways. Signal connections are made by copper fingers of the flexible printed circuit that are soldered to contact pads of the daughter boards. Power and ground connections are made by gold dot contacts of the flexible printed circuit that are pressed against contact pads of the daughter boards by pressure plates that are individually secured to the respective daughter boards. The flexible printed circuits are connected electrically to the mother board by gold dot contacts of the flexible printed circuit that are pressed against contact pads of the mother board by a spring biased pressure bar carried by the connector housing.

SUMMARY OF THE INVENTION

It is an object of the present invention to provide an electrical connector that is improved by incorporating one or more of the following features.

A feature of the invention is that all electrical connections can be made between the flexible printed circuits and the daughter boards without any need for solder connections thereby avoiding difficult and expensive manufacturing procedures.

Another feature of the invention is that the electrical connector has flexible printed circuits that are protected during handling and assembly by locating portions of the flexible printed circuits inside the connector housing.

Another feature of the invention is that the electrical connector includes compression plate assemblies that attach to each other through a heat frame to accurately align and press the gold dot contacts of the flexible electrical circuits against the contact pads of the daughter boards.

Another feature of the invention is that the compression plate assemblies are sized and located to protect practically all of the flexible printed circuit in conjunction with the connector housing.

Yet another feature of the invention is that the electrical connector includes a housing that attaches a heat frame for daughter boards accurately and securely in place so that the electrical connections between the gold dot contacts of the flexible electrical circuit and the contact pads of the daughter boards are maintained during use.

Still yet another feature of the invention is that the electrical connector includes provisions for coaxial and fiber optic connections to the mother board.

Further objects, features and advantages of the present invention will be apparent from the following description taken in conjunction with the accompanying drawings.

DESCRIPTION OF THE PREFERRED EMBODIMENT

Figure 1:
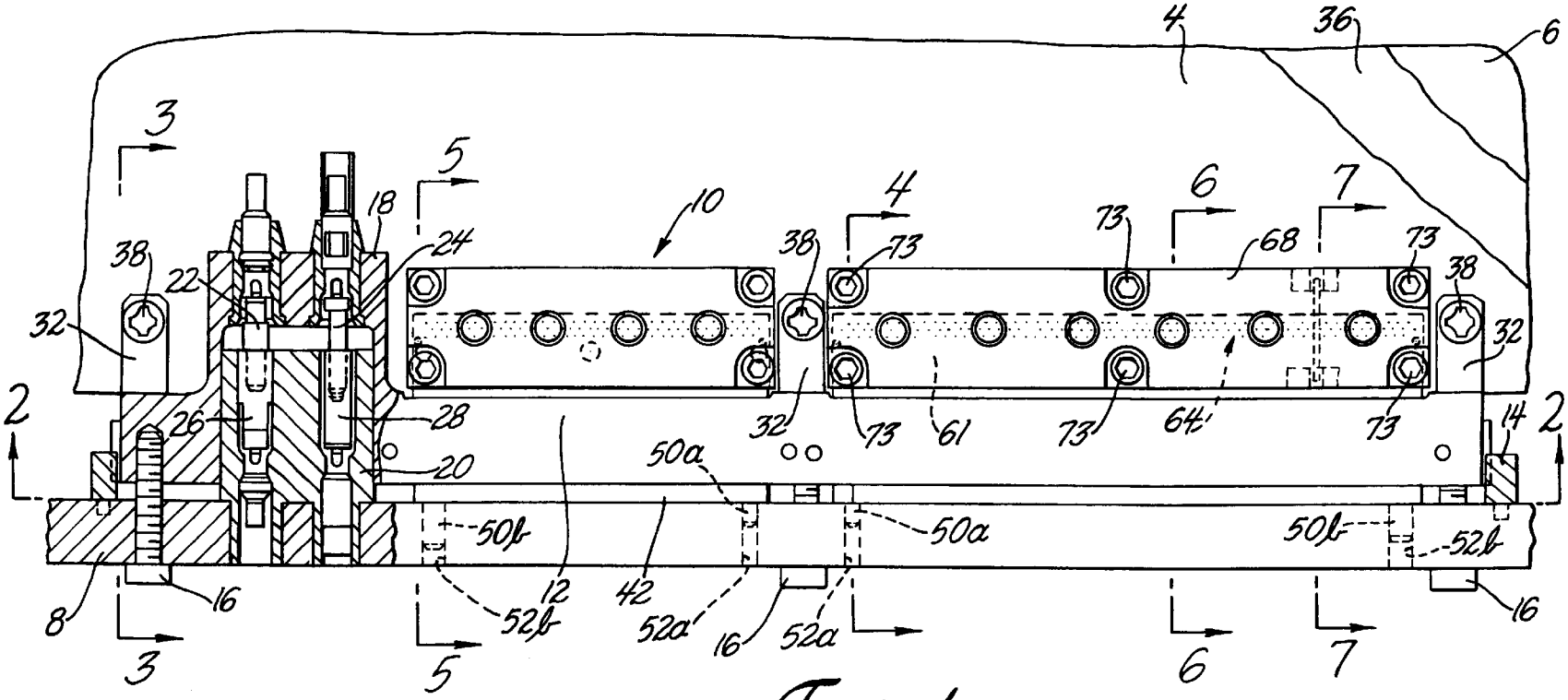
FIG. 1 is a partially sectioned front view of an electrical connector in which two daughter boards are connected to a mother board in accordance with the invention.

FIG. 1 illustrates two daughter boards 4 and 6 connected to a mother board 8 by an electrical connector in accordance with the invention, indicated generally at 10.

The electrical connector 10 comprises a housing 12 that is plugged into a molded thermoplastic rectangular guide frame 14 that is attached to the upper surface of the mother board 8 and secured to the mother board 8 by fasteners 16. Guide frame 14 has chamfered edges to guide housing 12 into place and polarizing tongues and grooves that cooperate with tongues and grooves in the ends of housing 12 to assure that housing 12 is plugged onto the mother board 8 in the correct orientation.

Housing 12 includes a socket 18 that mates with a plug 20 attached to the mother board 8 when housing 12 is plugged onto mother board 8. Socket 18 carries a male fiber optic contact pin 22 and a male electrical contact pin 24 that mate with female contact terminal 26 and female electrical terminal 28 carried by plug 20. Thus, the electrical connector 10 of the invention includes provisions for coaxial electric and fiber optic cable connections to the mother board that are made simultaneously with flexible circuit connections to the mother board 8 when connector housing 12 is plugged onto mother board 8.

Figure 2:
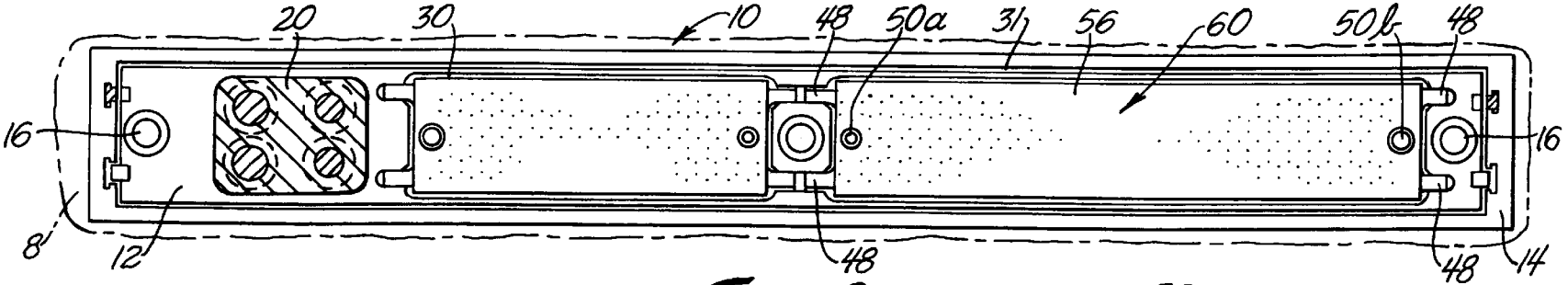
FIG. 2 is a bottom view of the electrical connector taken substantially along the line 2—2 of FIG. 1 looking in the direction of the arrows.
Figure 3:
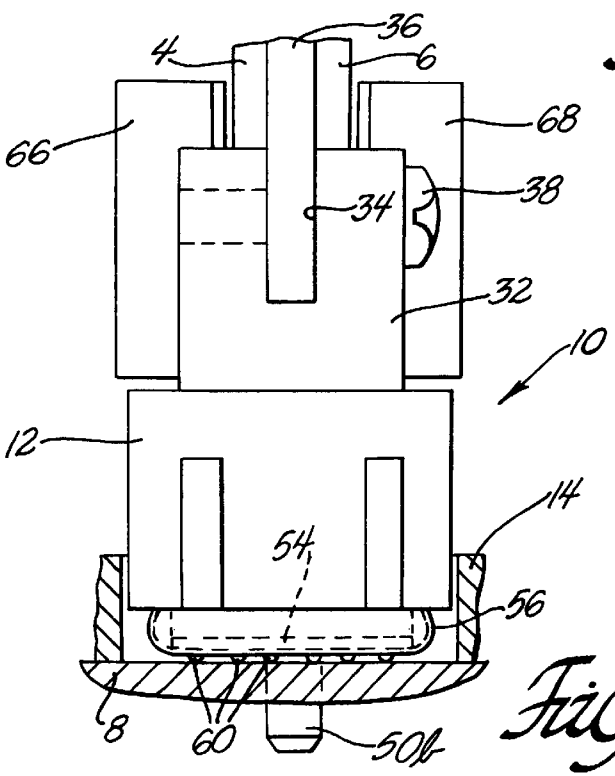
FIG. 3 is an end view of the electrical connector taken substantially along the line 3—3 of FIG. 1 looking in the direction of the arrows.

Housing 12 has two longitudinally spaced cavities 30 and 31 (FIG. 2) that extend through housing 12 in a vertical direction (as shown in FIG. 1) and three vertical ears 32. A vertical ear 32 is located at each longitudinal end of housing 12 and the third vertical ear is located between the cavities 30 and 31. Vertical ears 32 each have a precisely machined slot 34 for receiving the lower end of a vertical heat frame 36 as best shown in FIG. 3. Heat frame 36 is accurately and firmly attached to housing 12 by pan headed machine screws 38 in each of the vertical ears 32 which stabilize and maintain the position of the heat frame 36 during the life of electrical connector 10. Daughter boards 4 and 6 are secured to opposite faces of heat frame 36 by bonding or by any suitable fasteners that firmly and accurately locate the daughter boards 4 and 6 on heat frame 36 so that the daughter boards 4 and 6 are also stabilized and maintained in position during the life of electrical connector 10.

Electrical connector 10 further includes two compression plates 42 and 44 that are disposed in the housing cavities 30 respectively. Compression plates 42 and 44 and cavities 30 and 31 are essentially identical except for length and consequently only the compression plate 44 and housing cavity 31 shown at the right in FIG. 1 need be described in detail.

Compression plate 44 has an upper chamber 46, a pair of ears 48 at each end and two depending polarizing pins 50*a* and 50*b*. Ears 40 are disposed in vertical slots of housing 12 so that compression plate 44 slides vertically. Depending pins 50*a* and 50*b* are at opposite ends of compression plate 44. The pins 50*a* and 50*b* have different sizes. Pins 50*a* and 50*b* slide in mating holes 52*a* and 52*b* in mother board 8 to locate compression plate 44 accurately and in a correct orientation with respect to mother board 8.

Figure 4:
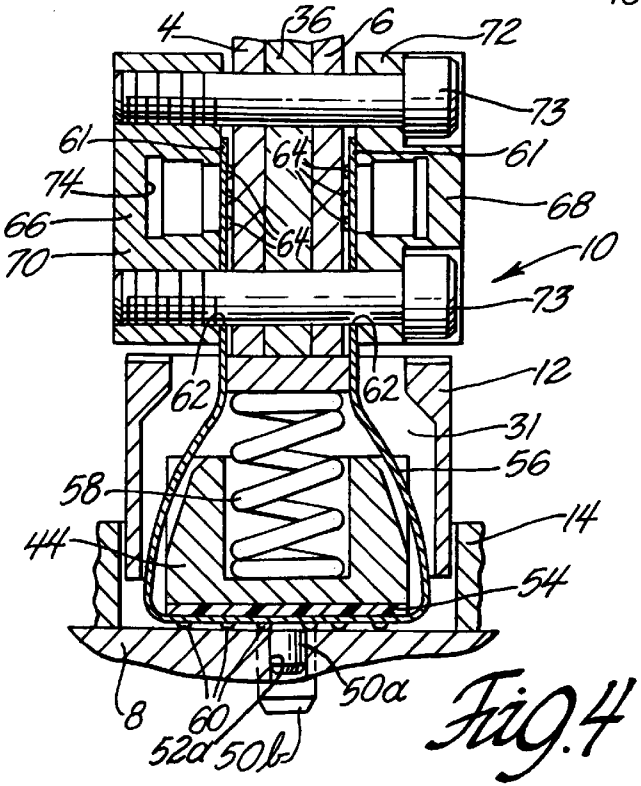
FIG. 4 is a cross sectional view of the electrical connector taken substantially along the line 4—4 of FIG. 1 looking in the direction of the arrows.

The bottom of compression plate 44 has an elastomeric cushion 54 for a flexible circuit 56 that is biased downwardly against mother board 8 by a spring 58 in chamber 46 that reacts against housing 12 as best shown in FIG. 4.

The side walls of compression plate 44 are tapered upwardly to facilitate looping or wrapping the flexible circuit 56 around the cushion 54 on the bottom of the compression plate. Flexible circuit 56 is looped completely around the bottom and side walls of compression plate 44 and exits through slots in the top wall of housing 12 so that the looped portion is located inside housing 12 and protected during handling and assembly. Flexible circuit 56 has an array of gold dot contacts 60 on the portion that contacts cushion 54 when flexible circuit 56 is attached to heat frame 36 and daughter boards 4 and 6 (as best shown in FIG. 4). Gold dot contacts are well known from U.S. Pat. No. 4,125,310 issued to Patrick A. Reardon, II, deceased et al. on Nov. 14, 1978, and U.S. Pat. No. 4,453,795 issued to Norbert L. Moulin on Jun. 12, 1984, which patents are hereby incorporated in this patent specification by reference.

Figure 5:
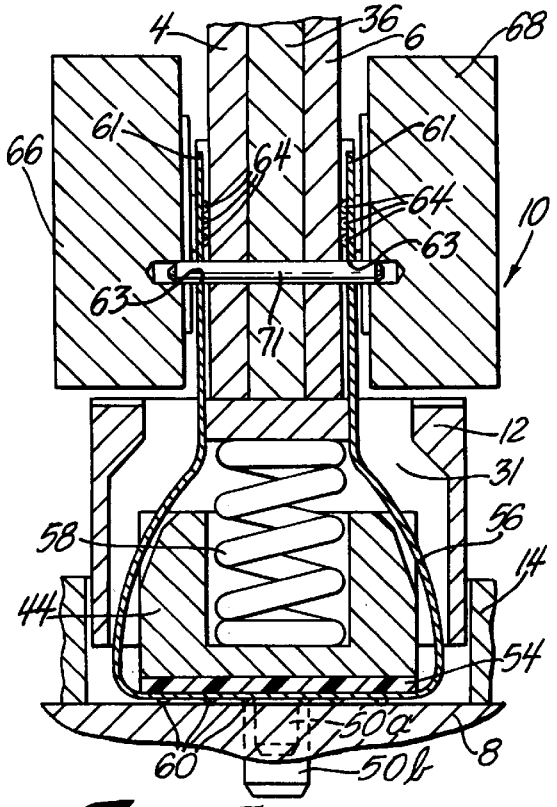
FIG. 5 is a cross sectional view of the electrical connection taken substantially along the line 5—5 of FIG. 1 looking in the direction of the arrows.

Each end portion 61 of flexible circuit 56 has two attachment holes 62 and two pilot holes 63 and an array of gold dot contacts 64 spaced above the holes 62 and 63 as shown in FIGS. 1, 4 and 5. End portions 61 are attached to support plate 36 and daughter boards 4 and 6 by two compression assemblies 66 and 68. Compression assemblies 66 and 68 straddle daughter boards 4 and 6 so that the opposite end portions 61 of flexible circuit 56 are pressed against the outboard faces of daughter boards 4 and 6 respectively as best shown in FIGS. 4–7.

Compression assemblies 66 and 68 comprise compression blocks 70 and 72 respectively, that are attached to each other by two rows of machine screws 73 that are above and below the arrays of gold dot contacts 64 respectively. The lower row of machine screws 73 extend through attachment holes 62. The attached compression blocks 70 and 72 carry pilot pins 71 at each end. Pilot pins 71 extend through pilot holes 63 and aligned holes in daughter boards 4 and 6 and frame 36 to locate the arrays of gold dot contacts 64 accurately with respect to contact pads on the outboard faces of the daughter boards 4 and 6 as best shown in FIG. 5. Compression blocks 70 and 72 cover end portions 61 and are located near the top of connector 12 so substantially the entire flexible printed circuit 56 is protected by housing 12 or compression assemblies 66 and 68.

Figure 6:
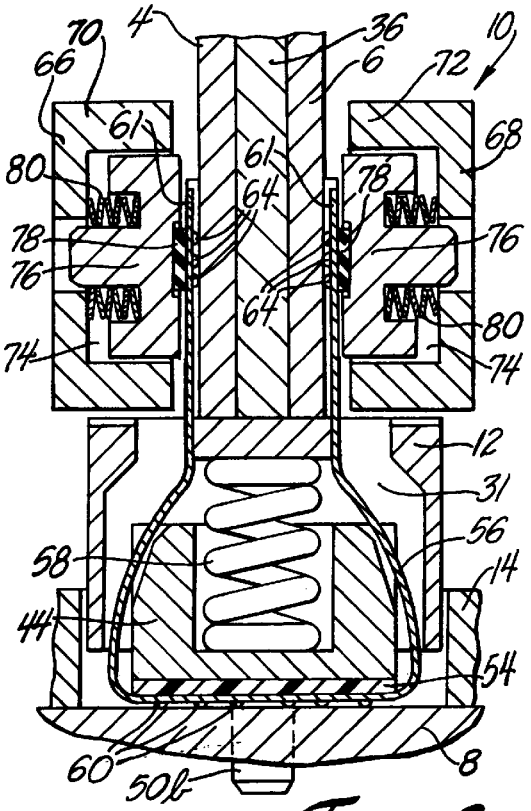
FIG. 6 is a cross sectional view of the electrical connection taken substantially along the line 6—6 of FIG. 1 looking in the direction of the arrows.
Figure 7:
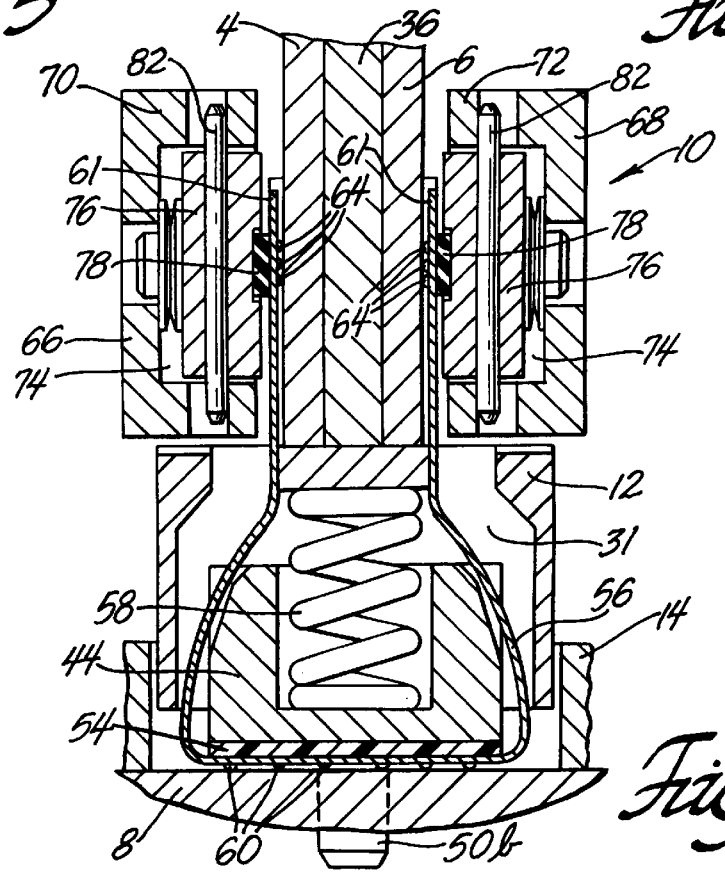
FIG. 7 is a cross sectional view of the electrical connection taken substantially along the line 7—7 of FIG. 1 looking in the direction of the arrows.

Compression blocks 70 and 72 each have a cavity 74 that is located behind the area of the flexible circuit 56 containing the arrays of gold dot contacts 64. Compression assemblies 66 and 68 further comprise spring biased plungers 76 that are housed in the cavities 74. Plungers 76 include cushions 78 that engage the flexible printed circuit 56 and bias the gold dot contacts 64 into a good electrical contact with the contact pads of daughter boards 4 and 6 under the action of Belleville springs 80 encircling the pilot stems of plungers 76 as best shown in FIGS. 1 and 6. Plungers 76 are retained in the respective compression block cavities by cross pins 82 that are pressed into bores of the plungers 76 with projecting ends disposed in oversize holes in compression blocks 70 and 72 as best shown in FIG. 7. This arrangement eliminates any need for solder connections between flexible printed circuit 56 and daughter boards 4 and 6. At the same time, compression plate 44 biases gold dot contacts 60 into good contact with the contact pads of mother board 8 under the action of spring 58.

Obviously, many modifications and variations of the present invention in light of the above teachings may be made. It is, therefore, to be understood that, within the scope of the appended claims, the invention may be practiced otherwise than as specifically described.

I claim:

1. A solderless connector having a flexible printed circuit for connecting printed circuit boards comprising:

a connector housing adapted for attachment to a daughter board and having a mating end adapted for securing the connector to a mother board;

a compression plate disposed in the mating end of the housing with a contact portion of the flexible printed circuit underlying a surface of the compression plate at the mating end of the connector;

a spring between an inside surface of the housing and the compression plate for pressing the contact portion of the flexible printed circuit against the mother board;

the flexible printed circuit having an end portion provided with an array of gold dot contacts for providing electrical contact of the flexible printed circuit with the daughter board;

a compression assembly for attaching the end portion of the flexible printed circuit to the daughter board;

the compression assembly including a compression block having a central cavity aligned with the array of gold dot contacts and a spring loaded plunger disposed in the central cavity pressing the gold dot contacts of the end portion of the printed circuit against the daughter board to make electrical contact.

2. The electrical connector as defined in claim 1 further including a heat frame that is attached to the connector housing for holding the daughter board and wherein the compression block is bolted to the heat frame.

3. The electrical connector as defined in claim 2 wherein the flexible printed circuit passes through a slot in the top of the connector housing and compression block is located near the top of the connector housing and covers the end portion of the flexible printed circuit.

4. A solderless electrical connector having a flexible printed circuit for connecting printed circuit boards comprising:

a heat frame having a first daughter board attached to a front surface of the heat frame and a second daughter board attached to a rear surface of the heat frame, a connector housing attached to the heat frame adjacent a lower end of the first and second daughter boards, the connector housing having a mating end adopted for securing the connector to a mother board;

a compression plate disposed in a cavity in the mating end of the housing with a spring disposed between an inside surface of the housing and the compression plate for pressing the compression plate toward the mother board;

the flexible printed circuit being looped around the compression plate and having opposite end portions attached to the respective daughter boards on opposite surfaces of the heat frame for making electrical connections between the flexible printed circuit and the daughter boards;

the end portions of the flexible printed circuit each having an array of gold dot contacts for providing electrical contact of the respective end portions of the flexible printed circuit with the respective daughters boards;

a compression assembly on each side of the frame for pressing the gold dot contacts disposed on the respective end portions of the flexible printed circuit against conductive pads on the respective daughter boards to make electrical contact; and the compression assemblies each including a compression block having a central cavity aligned with the gold dot contacts and a spring loaded plunger disposed in the central cavity pressing one of the end portions of the flexible printed circuit against one of the daughter boards.

5. The electrical connector as defined in claim 4 wherein the compression blocks are secured to each other by fasteners that extend through the heat frame and the daughter boards.

6. The electrical connector as defined in claim 5 wherein the compression blocks are fastened to each other above and below the central cavities.

7. The electrical connector as defined in claim 5 wherein the compression blocks cover the respective end portions of the flexible printed circuit and wherein the compressing blocks are located near an upper end of the connector housing so that essentially all of the flexible printed circuit is protected by the connector housing and the compression blocks.

8. The electrical connector as defined in claim 4 wherein the connector housing has a plurality of longitudinally spaced ears having precision slots that receive the lower end of the heat frame and the connector housing is attached to the heat frame by fasteners that extend through the lower end of the heat frame and at least part way through the ears on each side of the slots.

9. The electrical connector as defined in claim 4 wherein the connector housing includes a socket that carries a fiber optic contact and an electric contact for making electric and fiber optic cable connections to the mother board.

10. A solderless electrical connector having a flexible printed circuit for connecting printed circuit boards comprising:

a heat frame having a first daughter board attached to a front surface of the heat frame and a second daughter board attached to a rear surface of the heat frame, a connector housing attached to the heat frame adjacent a lower end of the first and second daughter boards by a plurality of longitudinally spaced ears with precision slots engaging the front and rear surfaces of the heat frame, the connector housing having a mating end adopted for securing the connector to a mother board;

a compression plate disposed in a cavity in the mating end of the housing with a spring disposed between an inside surface of the housing and the compression plate for pressing the compression plate toward the mother board;

the flexible printed circuit being looped around the compression plate and having opposite end portions outside the cavity for making electrical connections between the flexible printed circuit and the respective daughter boards;

the end portions of the flexible printed circuit each having an array of gold dot contacts for providing electrical contact of the respective end portions of the flexible printed circuit with the respective daughter boards;

a compression assembly on each side of the frame for attaching the end portions to the heat frame and pressing the gold dot contacts disposed on the respective end portions of the flexible printed circuit against conductive pads on the respective daughter boards to make electrical contact;

the compression assemblies each including a compression block having a central cavity aligned with the gold dot contacts and a spring loaded plunger disposed in the central cavity pressing one of the end portions of the flexible printed circuit against one of the daughter boards;

the compression blocks being fastened to each other by fasteners above and below the central cavities that extend through the heat frame and the daughter boards; and the compression blocks covering the respective end portions of the flexible printed circuit and being located near an upper end of the connector housing so that essentially all of the flexible printed circuit is protected by the connector housing and the compression blocks.

11. The solderless electrical connector as defined in claim 10 wherein the end portions of the flexible printed circuit have pilot holes and the compression assemblies include pilot pins that are carried by the compression blocks and that extend through the pilot holes and aligned holes in the daughter boards and the frame to locate the arrays of gold dot contacts accurately with respect to the daughter boards.

12. The solderless electrical connector as defined in claim 10 wherein each spring loaded plunger has a plurality of pilot stems disposed in pilot holes of the compression block and Belleville springs encircling the pilot stems.

13. The solderless electrical connector as defined in claim 12 wherein each spring loaded plunger includes a cushion that engages the flexible printed circuit behind the gold dot contacts.

14. The solderless electrical connector as defined in claim 12 wherein each plunger is retained in a cavity of one of the compression blocks by cross pins that are attached to the plunger with the ends of the cross pins projecting into oversize holes in one of the compression blocks.

* * * * *